US010662568B2

(12) United States Patent
Jackson

(10) Patent No.: US 10,662,568 B2
(45) Date of Patent: May 26, 2020

(54) SUSPENSION UNIT AND LAUNDRY WASHING MACHINE

(71) Applicant: Fisher & Paykel Appliances Limited, Auckland (NZ)

(72) Inventor: Russell Joseph Jackson, Manakau (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 0 days.

(21) Appl. No.: 15/611,560

(22) Filed: Jun. 1, 2017

(65) Prior Publication Data

US 2017/0268146 A1 Sep. 21, 2017

Related U.S. Application Data

(62) Division of application No. 14/127,448, filed as application No. PCT/NZ2012/000108 on Jun. 27, 2012, now Pat. No. 9,677,212.

(60) Provisional application No. 61/502,540, filed on Jun. 29, 2011.

(51) Int. Cl.

| | |
|---|---|
| ***D06F 37/20*** | (2006.01) |
| ***D06F 37/22*** | (2006.01) |
| ***D06F 37/24*** | (2006.01) |

(52) U.S. Cl.

CPC ..... *D06F 37/22* (2013.01); *D06F 37/20* (2013.01); *D06F 37/24* (2013.01)

(58) Field of Classification Search

CPC ..... D06F 37/20; D06F 37/22; D06F 37/24
See application file for complete search history.

(56) References Cited

U.S. PATENT DOCUMENTS

| | | | | |
|---|---|---|---|---|
| 2,533,722 A | | 12/1950 | De Remer | |
| 2,982,510 A | | 5/1961 | Curristen | |
| 3,373,961 A | | 3/1968 | Long | |
| 3,703,091 A | | 11/1972 | Steele | |
| 3,744,746 A | * | 7/1973 | Weir | D06F 37/24 248/569 |

(Continued)

FOREIGN PATENT DOCUMENTS

| | | |
|---|---|---|
| DE | 199 44 521 | 3/2001 |
| EP | 0546379 A1 | 6/1993 |

(Continued)

OTHER PUBLICATIONS

International Search Report; PCT/NZ2012/000108; dated Sep. 20, 2012; 6 pages.

(Continued)

*Primary Examiner* — Joseph L. Perrin
(74) *Attorney, Agent, or Firm* — Knobbe, Martens, Olson & Bear, LLP

(57) ABSTRACT

A suspension unit assembly comprises a strut having a first end and a second end and a coupling disposed at the first end of the strut. The coupling has a strut part connected to the strut and a mounting part configured to tilt relative to the strut part of the coupling. A spring is disposed about the strut, one end of the spring being restrained relative to the mounting part of the coupling so that tilting movement between the strut part and the mounting part of the coupling causes the spring to deform and provide a return force that acts to return the coupling to an equilibrium position.

18 Claims, 8 Drawing Sheets

(56) References Cited

U.S. PATENT DOCUMENTS

| | | | |
|---|---|---|---|
| 4,343,452 | A | 8/1982 | Bauer |
| 4,625,529 | A | 12/1986 | Anderson |
| 4,991,412 | A | 2/1991 | Bauer et al. |
| 5,117,659 | A | 6/1992 | Sharp |
| 5,344,116 | A | 9/1994 | Winkler |
| 5,549,182 | A | 8/1996 | Ehrnsberger |
| 5,606,879 | A | 3/1997 | Froelicher |
| 5,884,891 | A | 3/1999 | Hawkins |
| 5,946,946 | A | 9/1999 | Sharp |
| 6,397,643 | B1 | 6/2002 | Park |
| 6,474,113 | B1 | 11/2002 | Park |
| 9,340,916 | B2 | 5/2016 | Miller |
| 2007/0251278 | A1 | 11/2007 | Barcha |

FOREIGN PATENT DOCUMENTS

| | | |
|---|---|---|
| GB | 772419 | 4/1957 |
| GB | 1114514 | 5/1968 |
| GB | 1115103 | 5/1968 |
| GB | 1283669 A | 8/1972 |
| GB | 1 387 259 | 3/1975 |
| GB | 1599267 A | 9/1981 |

OTHER PUBLICATIONS

Written Opinion; PCT/NZ2012/000108; dated Sep. 20, 2012; 7 pages.
Extended European Search Report for PCT/NZ2012000108, dated Jun. 18, 2015, 5 pages.

* cited by examiner

SUSPENSION UNIT AND LAUNDRY WASHING MACHINE

CROSS-REFERENCE TO RELATED APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

The present invention relates to a suspension unit. More specifically the invention relates to a suspension unit for use in a washing machine for dynamically supporting a washing machine tub and drum assembly.

Description of the Related Art

Conventional washing machine tub and drum assemblies are hung by springs or spring and damper assemblies which act in tension. A significant disadvantage of hung systems is that typically the suspended assembly is hung from the top of the cabinet enclosing the machine internal components. Therefore the cabinet must be structurally strong enough to carry all the oscillating suspension forces. An advantage of a hung system is that it is inherently self centering because the lowest potential energy state is in the centre of the movement range. Therefore a hung system is stable.

Using suspension units, for example suspension struts, in compression to support the tub from below enables the forces generated by the tub dynamic assembly to be transmitted directly into the base of the washing machine. The cabinet therefore has less structural demands and can be somewhat isolated from the vibration source of the drum and tub.

The main disadvantage of a suspension system that operates in compression is that it does not inherently self centralize the dynamic assembly and therefore can provide less stability than a hung system.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved suspension unit or laundry machine, or to at least provide the public or industry with a useful choice.

SUMMARY OF THE INVENTION

In one aspect, the present invention consists in a laundry machine comprising:

- a dynamically suspended assembly including a drum for holding laundry rotationally mounted with the dynamically suspended assembly,
- a supporting structure below the dynamically suspended assembly, and
- at least one suspension assembly coupled between the dynamically suspended assembly and the supporting structure for supporting the dynamically suspended assembly, the suspension assembly coupled to the supporting structure below the dynamically suspended assembly, the suspension assembly comprising:

- a strut having a first end and a second end,
- a coupling disposed at the first end of the strut, the coupling having a strut part connected to the strut and a mounting part mounted to or integrally formed with one of the dynamically suspended assembly and the supporting structure, the mounting part of the coupling configured to tilt relative to the strut part of the coupling, the second end of the strut being coupled to the other one of the dynamically suspended assembly and the supporting structure, and
- a spring disposed about the strut, a first end of the spring being restrained relative to the mounting part of the coupling and a second end of the spring is restrained relative to the strut or the other one of the dynamically suspended assembly and the support structure so that lateral or bending stiffness of the spring resists tilting movement between the strut part and the mounting part of the coupling to return or maintain the coupling to or in an equilibrium position.

To restrain the first end of the spring relative to the mounting part of the coupling, the first end of the spring may be fixed or mounted to the mounting part of the coupling, or to one of the dynamically suspended assembly and the supporting structure that the mounting part of the coupling is mounted to or integrally formed with.

In one embodiment, the mounting part of the coupling is connected to or integrally formed with the dynamically suspended assembly and the second end of the strut is coupled to the support structure, the first end of the spring being restrained relative to the mounting part of the coupling and the second end of the spring being restrained relative to the strut or the support structure.

Preferably the coupling at the first end of the strut is a first coupling and the suspension assembly has a second coupling disposed at the second end of the strut, the second coupling having a strut part connected to the strut and a mounting part connected to or integrally formed with the other one of the dynamically suspended assembly and the supporting structure, the mounting part of the second coupling configured to tilt relative to the strut part of the second coupling, and a second end of the spring being restrained relative to the strut or the mounting part of the second coupling.

To restrain the second end of the spring relative to the mounting part of the second coupling, the second end of the spring may be fixed or mounted to the mounting part of the second coupling, or to the other one of the dynamically suspended assembly and the supporting structure that the mounting part of the second coupling is mounted to or integrally formed with.

Preferably the coupling is a pivot coupling. Preferably the second coupling is a pivot coupling. Preferably the coupling allows at least two degrees of freedom of rotational movement between the strut part and the mounting part of the coupling. Preferably the second coupling allows at least two degrees of freedom of rotational movement between the strut part and the mounting part of the second coupling.

In a preferred embodiment, the mounting part of the coupling has an extension extending axially towards the second end of the strut and away from a centre of tilting or pivoting movement of the coupling, the first end of the spring being supported by the extension.

In one embodiment, the strut part of the coupling is adapted to move axially relative to the strut. In this embodiment, preferably the strut part of the coupling and the strut are adapted to provide frictionally damped axial movement between the strut part of the coupling and the strut. The strut may have an abutment disposed adjacent the strut part of the coupling that limits axial movement of the coupling with respect to the strut, the spring biasing the coupling toward the abutment so that axial movement of the strut part of the coupling away from the abutment compresses the spring.

Preferably the first end of the spring being restrained relative to the mounting part of the coupling has a greater diameter than the second end of the spring. For example, the spring is a conical spring or is approximately conical or frustoconical.

Preferably the strut part and the mounting part of the coupling are adapted to provide frictionally damped movement between the strut part and the mounting part of the coupling.

Preferably the strut part of the coupling comprises a pivot cup or ball and the mounting part of the coupling comprises a seat that supports the pivot cup or ball to provide pivoting movement between the strut part and the mounting part of the coupling. In one embodiment, the strut part of the coupling comprises the pivot cup and the mounting part of the coupling comprises the seat and a cap, complimentarily curved facing surfaces of the seat and the cap defining a raceway for receiving the cup. Preferably a rim of the cup and a closed perimeter of the raceway define a limit to the extent of pivoting movement between the strut part and the mounting part of the coupling. Preferably the seat and the cap bear against the cup to create a frictional damping force that opposes movement of the cup within the raceway. Preferably a clamping force between the seat and cap defines an amount of frictional damping between the strut part and mounting part of the coupling. Preferably a surface friction damping element is located between the cup and the raceway to influence frictional damping characteristics of the coupling.

In an alternative embodiment the mounting part of the coupling comprises the seat and a cap, and the coupling comprises a spring, the spring acting between the cap and the cup or the ball to maintain a positive force between the cup or the ball and the seat.

The seat or the cap may be integrally formed with one of the dynamically suspended assembly and the supporting structure.

Preferably the strut part of the coupling comprises a sleeve for connecting the pivot cup to the strut. Preferably the sleeve and the strut are formed to provide frictionally damped axial movement between the cup and the strut. Preferably a surface friction damping element is located between the sleeve and the strut to influence frictional damping characteristics between the coupling and the strut.

Preferably the second coupling is a ball and socket joint. In one embodiment, the strut part of the second coupling is adapted to move axially relative to the strut.

Preferably the laundry machine comprises at least three said suspension assemblies. Preferably each said suspension assembly is aligned so that a line along the longitudinal axis of the spring of each suspension assembly extends within a distance of the centre of gravity of the dynamically suspended assembly, the distance being the smallest of one quarter of the diameter of the drum or one quarter of the length of the drum. More preferably, a line along the longitudinal axis of the spring of each suspension assembly extends within 10 cm of the centre of gravity of the dynamically suspended assembly.

In one embodiment, the second end of the spring is restrained relative to the mounting part of the second coupling, and the dynamically suspended unit is supported by a single said suspension unit, a line along the longitudinal axis of the spring of the suspension assembly extending within 10 cm of the centre of gravity of the dynamically suspended assembly.

Preferably the laundry machine is a washing machine, and the dynamically suspended assembly comprises a tub for holding washing fluid and the drum is rotationally mounted within the tub, and the at least one suspension assembly is coupled between the tub and the supporting structure for supporting the dynamically suspended assembly, the suspension assembly coupled to the supporting structure below the tub. For example, the laundry machine is a horizontal axis washing machine. The laundry machine may be a top loading horizontal axis washing machine, the drum being supported at each end by a shaft rotationally supported by bearings located at the tub. Alternatively the laundry machine is a dryer.

In another aspect, the present invention consists in a laundry machine comprising:

a dynamically suspended assembly including a drum for holding laundry rotationally mounted with the dynamically suspended assembly, a supporting structure below the dynamically suspended assembly, and at least one suspension assembly for supporting the dynamically suspended assembly, each suspension assembly having a strut, a first coupling adjacent a first end of the strut for coupling the strut to the tub, a second coupling adjacent a second end of the strut for coupling the strut to the supporting structure below the tub, and a compression spring between the first and second couplings, wherein each suspension assembly is aligned so that a longitudinal axis of the compression spring of each suspension unit extends within a distance of the centre of gravity of the dynamically suspended assembly, the distance being the smallest of:

one quarter of the diameter of the drum, and one quarter of the length of the drum.

In one embodiment the laundry machine comprises at least two said suspension assemblies. In a preferred embodiment the laundry machine comprises at least three said suspension assemblies. Most preferably, the laundry machine comprises four said suspension assemblies. Each suspension assembly may comprise a suspension assembly as described above.

More preferably a line along the longitudinal axis of the compression spring of each suspension assembly extends within 10 cm of the centre of gravity of the dynamically suspended assembly.

Preferably the laundry machine is a washing machine, and the dynamically suspended assembly comprises a tub for holding washing fluid and the drum is rotationally mounted within the tub, and the at least one suspension assembly is coupled between the tub and the supporting structure for supporting the dynamically suspended assembly, the suspension assembly coupled to the supporting structure below the tub.

In one embodiment the washing machine is a horizontal axis washing machine. For example, the washing machine is a top loading washing machine, the drum being supported at each end by a shaft rotationally supported by bearings located at the tub.

Alternatively the laundry machine is a dryer.

In another aspect, the present invention consists in a laundry machine comprising:

a dynamically suspended assembly including a drum for holding laundry rotationally mounted with the dynamically suspended assembly, a supporting structure below the dynamically suspended assembly, a pivot coupling mounted to one of the dynamically supported assembly and the supporting structure and a strut connected between the pivot coupling and the other one of the dynamically supported assembly and the supporting structure, the pivot coupling comprising:

a first part, and a second part configured to pivot relative to the first part of the coupling, the first part attached to the strut and the second part mounted to said one of the dynamically supported assembly and the supporting structure, wherein the first part of the pivot coupling comprises a pivot cup or ball having a first curved surface, and the second part of the pivot coupling comprises a second curved surface providing a seat that supports the first curved surface of the pivot cup or ball to provide pivoting movement between the first part and the second part of the pivot coupling, and a component for maintaining a positive force between the first and second curved surfaces, wherein the first part of the coupling does not significantly support the weight of the dynamically suspended system so that a friction damping force between the first and second curved surfaces is significantly independent of the weight of the dynamically suspended system.

In one embodiment the first part of the pivot coupling comprises the pivot cup, and the component for maintaining a positive force between the first and second curved surfaces is a cap, the second part of the pivot cup comprising the cap and the seat, complimentarily curved facing surfaces of the seat and the cap defining a raceway for receiving the pivot cup, a clamping force between the seat and cap maintaining the positive force between the first and second curved surfaces. The second curved surface comprises a convex surface or concave surface and the cap comprises a third curved surface, the third curved surface comprising the other one of a convex surface or concave surface, the second curved surface facing the third curved surface, the second curved surface and the third curved surface defining the raceway, and the first curved surface of the cup comprises the other one of a convex surface and a concave surface, and the pivot cup comprises a fourth curved surface, the fourth curved surface opposite the first curved surface, the fourth curved surface of the cup corresponding to the third curved surface of the cap.

each of the concave and convex surfaces of the second part and the pivot cup having the same radius of curvature.

In an alternative embodiment the second part comprises a cap, and the component is a spring acting between the cap and the pivot cup or ball to maintain the positive force between the first and second curved surfaces. In one alternative embodiment the first part of the pivot coupling comprises the pivot cup and the pivot coupling comprises a bearing element between the pivot cup and the spring, the bearing element contacting a curved side of the pivot cup opposite to the first curved surface.

Preferably the first curved surface is convex and the second curved surface is concave.

In the embodiment comprising a raceway, preferably the seat and the cap bear against the cup to create a frictional damping force that opposes movement of the cup within the raceway. Preferably a rim of the cup and a closed perimeter of the raceway define a limit to the extent of pivoting movement between the first part and the second part of the pivot coupling. Preferably the seat and the cap bear against the cup to create a frictional damping force that opposes movement of the cup within the raceway.

Preferably the seat or the cap is integrally formed with one of the dynamically suspended assembly and the support structure.

Preferably the pivot coupling allows at least two degrees of freedom of rotational movement between the first part and the second part of the coupling.

Preferably, the first part of the pivot coupling is adapted to move axially relative to the strut, or the laundry machine comprises a joint between the strut and the other one of the dynamically supported assembly and the supporting structure for providing axial movement between the strut and the other one of the dynamically supported assembly and the supporting structure.

In a preferred embodiment, the first part of the pivot coupling and the strut are adapted to provide frictionally damped axial movement between the first part of the pivot coupling and the strut. Preferably the strut has an abutment disposed adjacent the first part of the pivot coupling that limits axial movement of the pivot coupling with respect to the strut. Preferably the first part of the pivot coupling comprises a sleeve for connecting the pivot cup to the strut. Preferably the sleeve and the strut are formed to provide frictionally damped axial movement between the cup and the strut. Preferably a surface friction damping element is located between the sleeve and the strut to influence frictional damping characteristics between the pivot coupling and the strut.

Preferably a surface friction damping element is located between the first curved surface and the second curved surface to influence frictional damping characteristics of the pivot coupling.

Preferably the laundry machine comprises a compression spring between the second part of the coupling and the other one of the dynamically supported assembly and the supporting structure.

In one embodiment the laundry machine is a washing machine, for example a horizontal washing machine. Alternatively the laundry machine is a dryer.

In another aspect, the present invention consists in a laundry machine comprising:

a dynamically suspended assembly including a drum for holding laundry rotationally mounted with the dynamically suspended assembly, a supporting structure below the dynamically suspended assembly, and at least one suspension assembly coupled between the dynamically suspended assembly and the supporting structure for supporting the dynamically suspended assembly, the suspension assembly coupled to the supporting structure below the dynamically suspended assembly, the suspension assembly comprising:

a strut, an upper coupling and a and lower coupling each having a mounting foundation that is configured for substantially fixed securement to the dynamically suspended assembly and the supporting structure respectively, one of the upper and lower couplings defining a pivot joint that acts between the strut and the dynamically suspended assembly or the supporting structure, and a spring disposed about the strut, one end of the spring being restrained relative the mounting foundation of the coupling defining the pivot joint and the other end of the spring being restrained relative to either the strut or the mounting foundation of the other coupling so that pivoting movement of the pivot joint causes the spring to deform and provide a return force that acts to return the pivot joint to an equilibrium position.

The term "comprising" as used in this specification and provisional claims means "consisting at least in part of". When interpreting each statement in this specification and provisional claims that includes the term "comprising", features other than that or those prefaced by the term may also be present. Related terms such as "comprise" and "comprises" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF THE PREFERRED EMBODIMENT

Figure 1:
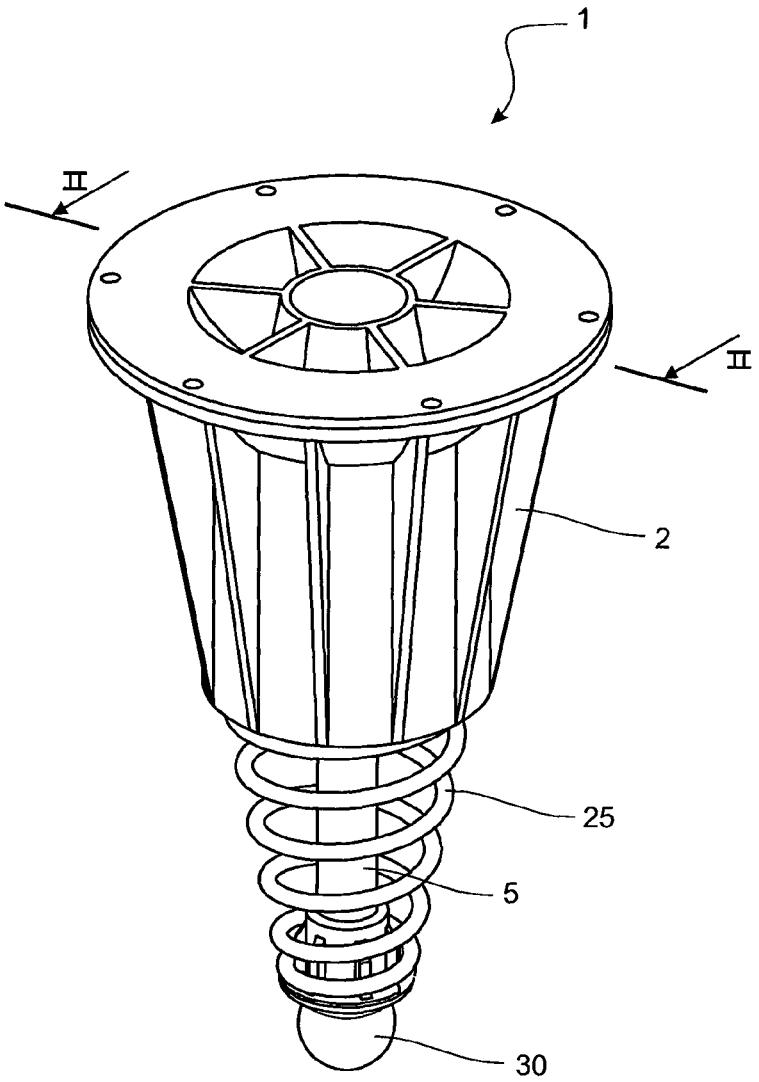
FIG. 1 shows a suspension unit according to one embodiment of the present invention.

With reference to FIGS. 1 to 7, the invention comprises a suspension unit 1. The suspension unit comprises a strut or shaft 5, a coupling 2 disposed toward a first end 7 of the strut, and a spring 25 extending from the coupling towards a second end 8 of the strut.

The coupling 2 comprises a strut part 15 connected to the strut and a mounting part 3. The mounting part and the strut part are mutually adapted to allow the two parts to tilt or pivot with respect to each other. That is, the mounting part 3 of the coupling 2 can tilt or pivot relative to the strut 5 or the strut part 15 of the coupling, and the strut or strut part 15 of the coupling can tilt or pivot relative to the mounting part 3 of the coupling.

In this specification and claims, tilt, tilting, pivot and pivoting are used to describe movement between the strut part and the mounting part of the coupling that causes a longitudinal axis of these parts to tilt relative to one another. Pivoting or tilting movement in this specification and claims is intended to also mean rotational movement with at least one degree of freedom about a centre of rotation. Preferably the coupling 2 provides tilting or pivoting movement that allows for rotation with at least two degrees of freedom about a centre of rotation. That is, rotational movement about the centre of rotation in any lateral direction with respect to the longitudinal axis of the strut 5. Preferably the coupling 2 provides tilting or pivoting movement that allows for rotation with three degrees of freedom about a centre of rotation.

Figure 2:
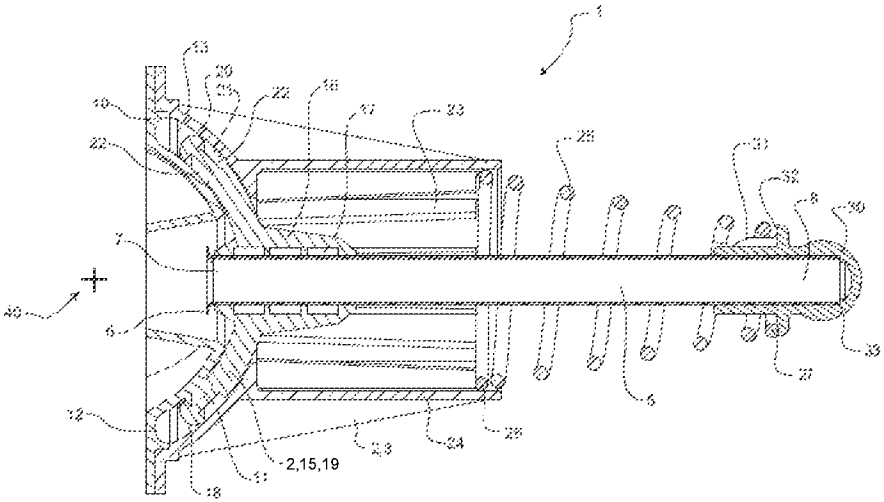
FIG. 2 is a cross section of the suspension unit of FIG. 1 on line II-II.
Figure 3:
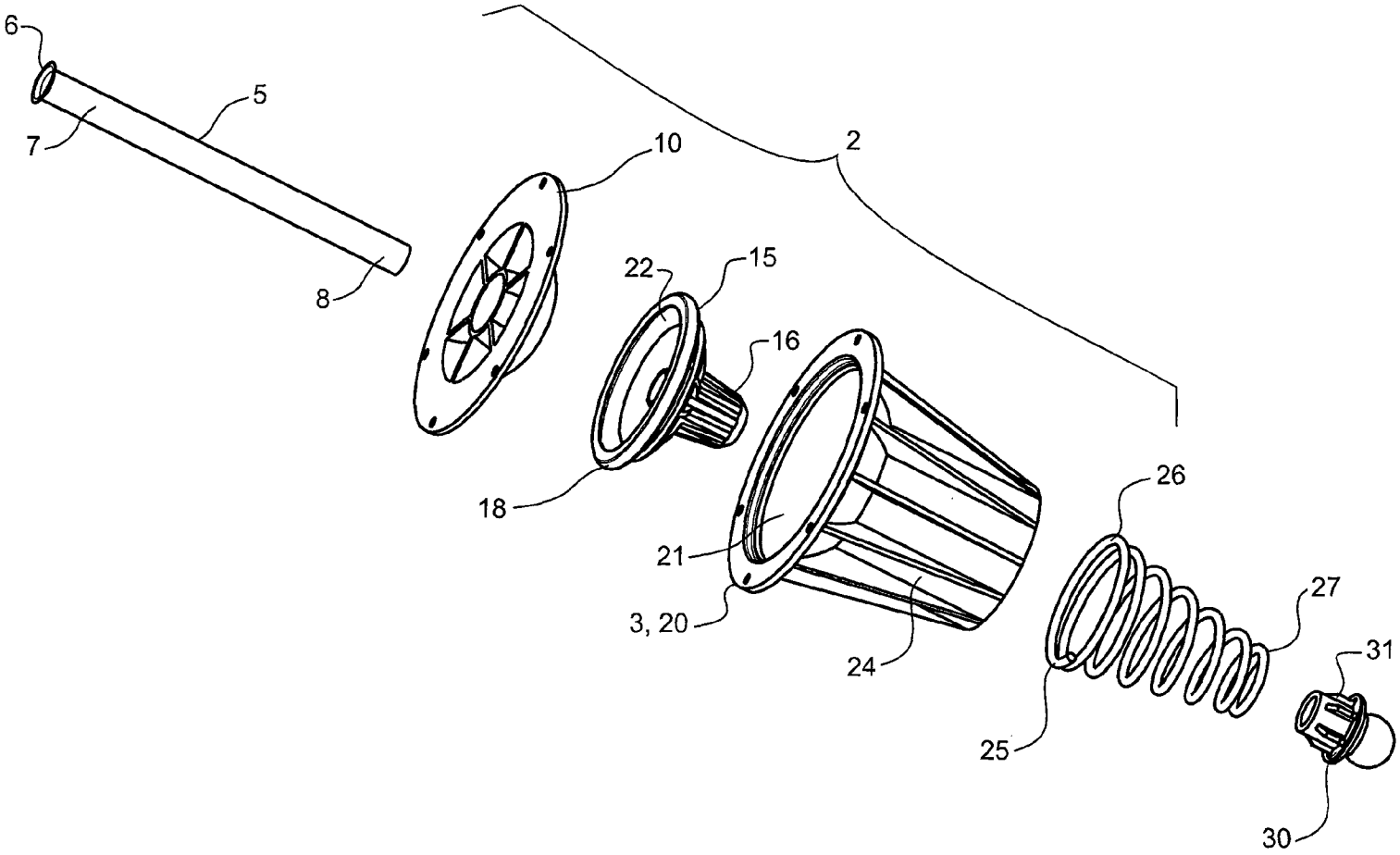
FIG. 3 is an exploded view of the suspension unit of FIG. 1.
Figure 5:
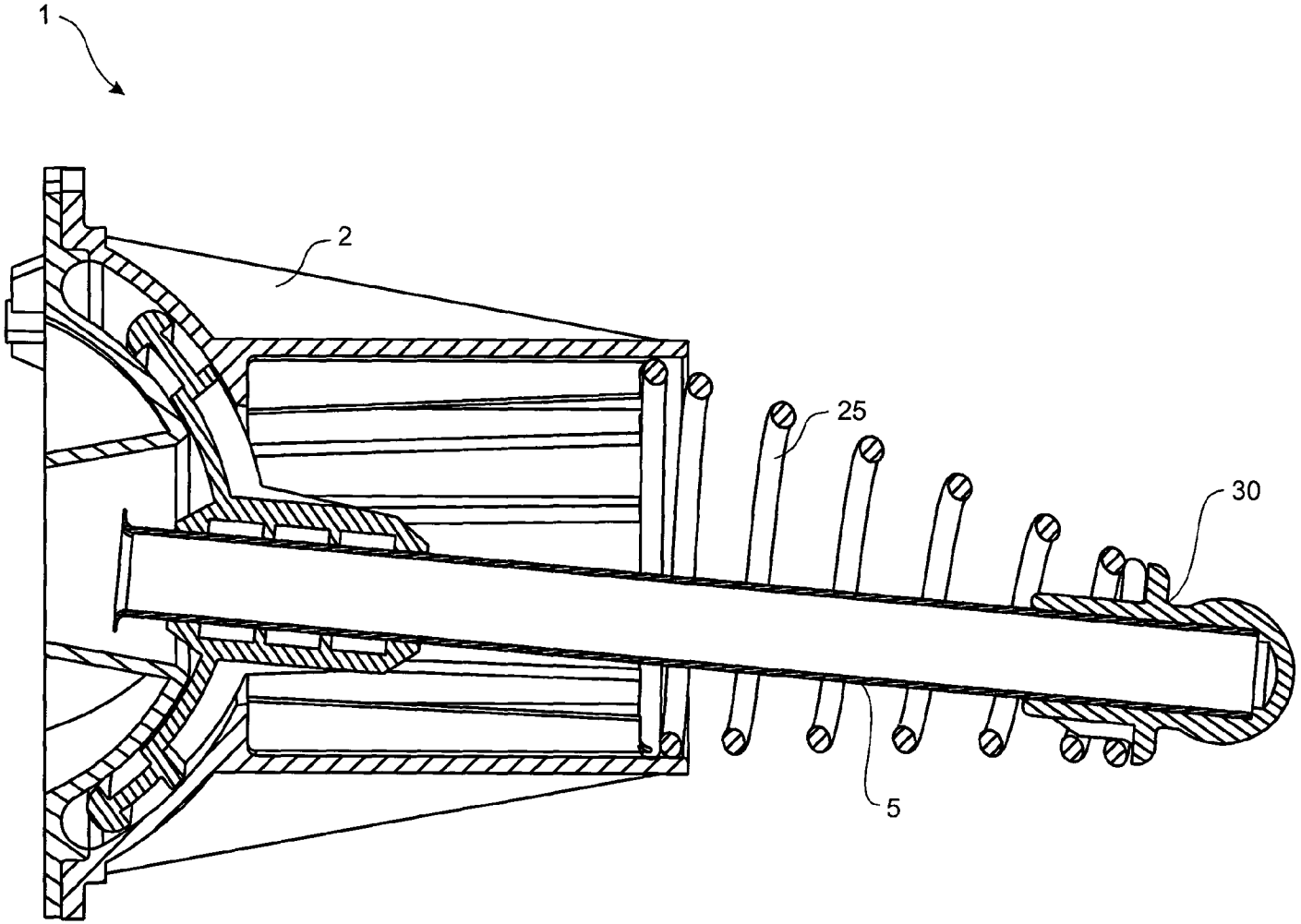
FIG. 5 is a cross section of the suspension unit of FIG. 1 with a mounting part of a coupling tilted or pivoted away from a central position relative to a strut and strut part of the coupling.

As best shown in FIG. 2, a first end 26 of the spring 25 is restrained relative to the mounting part 3 of the coupling 2. This arrangement utilises the lateral stiffness of the spring to provide a force to resist tilting movement of the mounting part of the coupling away from an equilibrium or central position of the strut part of the coupling. Tilting or pivoting movement between the mounting part of the coupling and the strut or strut part of the coupling causes the spring to bend or deform laterally since the spring is attached to or restrained relative to the mounting part of the coupling. FIG. 5 illustrates the mounting part of the coupling tilted or pivoted away from a central position relative to the strut and strut part of the coupling. The lateral stiffness of the spring will resist bending and lateral deflection of the spring and thus the lateral stiffness of the spring will act to return the coupling to the equilibrium position. In the illustrated embodiments, the equilibrium position for the suspension unit is a central position where the spring is centred on the strut and the longitudinal axis's of the mounting part and strut part of the coupling are aligned.

In the illustrated embodiments, one end of the spring is restrained relative to the mounting part of the coupling and the other end of the spring is restrained relative to the strut, so that tilting movement between the parts of the coupling causes the spring to bend or deform laterally. As described above, the lateral stiffness of the spring will resist bending and lateral deflection of the spring. Thus a suspension unit arrangement according to the invention uses the lateral stiffness of the spring to resist pivoting or tilting movement between the mounting part and the strut part of the coupling.

The illustrated suspension unit has a second coupling 30 at the second end 8 of the strut. The second coupling allows the suspension unit to tilt or pivot relative to a support structure to which the second coupling is attached. Preferably the second coupling provides at least two degrees of freedom of rotational movement between the second end of the strut and the supporting structure. Preferably the second coupling provides three degrees of freedom. Preferably the second coupling is a ball joint. As shown, the ball 33 of the ball joint is attached at the end of the strut 5, and a corresponding socket (not shown) is mounted to a supporting structure. The socket or mounting part of the second coupling may be included as a part of a suspension unit assembly for mounting to a support structure.

Figure 7:
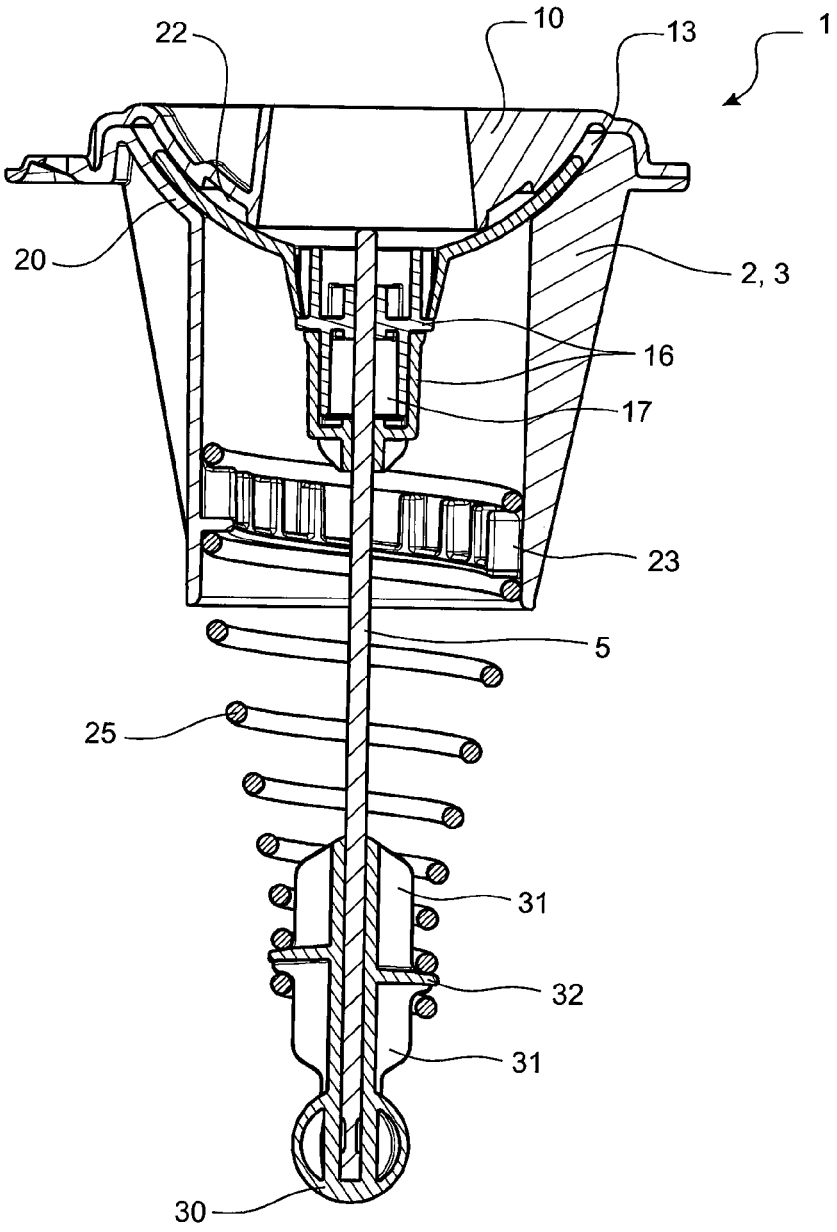
FIG. 7 is a cross sectional view of another alternative suspension unit assembly.

In the illustrated embodiments and as best shown in FIGS. 2 and 7, the second end 27 of the spring is restrained relative to the second end of the strut. In an alternative embodiment, the second end of the spring is restrained relative to a mounting part of the second coupling, or to a supporting structure supporting the suspension unit. With the first end of the spring restrained relative to the mounting part of the coupling at the first end of the strut and the second end of the spring restrained relative to the mounting part of the second coupling, any tilting movement of the mounting parts of the couplings relative to the strut will bend or deform the spring. And as described above in relation to the illustrated embodiments, the lateral stiffness of the spring will resist bending of the spring and thus the lateral stiffness of the spring will act to return the coupling to the equilibrium position.

In a further alternative embodiment, the second end of the strut may be rigidly fixed to a supporting structure, with the second end of the spring fixed relative to the second end of the strut or to the supporting structure.

In the preferred embodiment, the coupling at the first end of the strut (the first coupling) is a pivot coupling, and preferably the second coupling is a pivot coupling. Preferably the first coupling allows three degrees of freedom of rotational movement between the strut part and the mounting part of the first coupling. And preferably the second coupling allows three degrees of freedom of rotational movement between the strut part and the mounting part of the second coupling.

In an alternative embodiment, the first coupling or the second coupling or both couplings could, by example, be formed as an elastomeric block or member coupled between an end of the strut and a corresponding structure or assembly. The resiliency of the elastomeric block allows a strut part and a mounting part of the coupling to tilt relative to one another. For example, a flange for attaching the strut to the elastomeric block could be the strut part of the coupling. And a flange for attaching the elastomeric block to a tub could be the mounting part of the coupling. One embodiment of the invention requires a coupling at one end having a mounting part and a strut part, the coupling adapted to allow relative tilting movement between the strut and mounting parts, and the spring restrained relative to the mounting part of the coupling.

The preferred embodiment comprises couplings that isolate significant lateral loads from acting on the strut. A pivot coupling at each end of the strut mostly isolates lateral forces from acting on the strut. Since the spring is restrained relative to the mounting side of at least one of the pivot couplings, a lateral force or bending moment acting on the suspension unit is mostly applied to or resisted by the spring and not the strut. This means the strut can be lighter weight than a strut of a conventional suspension unit. For example, the embodiment of FIG. 7 comprises a lightweight strut.

In the preferred embodiment the end of the spring being restrained relative to the mounting part of the coupling has a significantly larger diameter than the diameter of the strut 5. This is to allow the strut to move about as required without contacting the spring at the coupling end 7 of the strut. Where the other end (second end) of the spring is restrained relative to the strut, it is preferred that this second end of the spring has a smaller diameter compared to the end of the spring at the coupling 2 for convenient attachment to the strut or a strut part of the coupling at the second end of the strut. As shown in the illustrated embodiments, the spring is a conical spring or is approximately conical or frustoconical.

The first end of the spring is received or captured by a radial inwardly facing surface of the mounting part 3 of the coupling 2. Axially the spring bears against an axially facing surface of the coupling. For example, in the embodiment of FIG. 2 the spring bears against an end surface of longitudinal ribs 23 located in an internal cavity of the mounting part of the coupling. In the embodiment of FIG. 7, longitudinal ribs and an axial facing surface are located between two adjacent turns of the spring to capture the spring axially. The second end of the coupling is located on an outside diameter of the strut 5 or part of the coupling at the second end of the strut. In the illustrated embodiments, the second end of the spring locates on the radially facing surface of longitudinal ribs 31 formed as part of the strut part of the second coupling. The second end of the coupling bears axially against a shoulder 32. In the embodiment of FIG. 7, the shoulder or lateral flange 32 locates between two adjacent turns of the spring.

In an alternative embodiment where the second end of the spring is restrained relative to a support structure, the diameter of the spring at the second end must be sufficient for the spring to extend past the strut part of the second coupling to attach to the mounting part of the second coupling or a support structure to which the mounting part of the second coupling is fixed.

Preferably the mounting part of the first coupling has an extension or extension member 24 extending axially towards the second end of the strut and away from a centre 40 of tilting or pivoting movement of the first coupling. The first end of the spring is supported by the extension 24 at an axial distance from the centre 40 of tilting or pivoting movement of the coupling.

A spring provides both lateral stiffness and axial stiffness. Where a spring is supported, for example at one end, and a lateral force is applied to the spring at a position axially spaced from the supported end of the spring, the lateral stiffness of the spring resists the spring being deflecting laterally.

The further the first end 26 of the spring is axially spaced from the pivot centre 40, the more the first end of the spring is deflected laterally for a given amount of pivoting between the strut and mounting parts of coupling 2. So, by spacing the first end of the spring away from the pivot centre, the amount of lateral deflection of the spring is increased for a given angle of tilt between the strut part and the mounting part of the coupling 2. The lateral force required to deflect a spring laterally is dependent on the amount of lateral deflection. Therefore, spacing the first end of the spring away from the pivot centre, by providing extension 24, increases the lateral stiffness of the suspension unit.

In a suspension unit according to the present invention with one end of the spring restrained relative to a mounting side of a coupling, a desired amount of lateral stiffness and a desired amount of linear stiffness can be achieved with a single spring by varying the position of the spring relative to the pivot centre.

In the preferred embodiment the strut part 15 and the mounting part 3 of the coupling 2 are adapted to provide frictionally damped movement between the strut part and the mounting part of the coupling. In the embodiments of FIGS. 2 and 7, the strut part of the coupling comprises a pivot cup 19 and the mounting part of the coupling comprises a raceway 13 that supports the pivot cup to provide pivoting movement between the strut part and the mounting part of the coupling. The mounting part of the coupling comprises two parts, a seat 20 and a cap 10. The seat and cap have complimentarily curved facing surfaces 21 and 11 that define the raceway 13. The complementary curved surfaces comprise a convex surface and a concave surface facing the convex surface, the convex and concave surfaces defining the raceway. The curvature of the convex and concave surfaces matches the curvature of the curved surfaces of the pivot cup. The pivot cup comprises a concave surface corresponding to the convex surface of the raceway, and a convex surface corresponding to the concave surface of the raceway. The seat and the cap bear against the cup to create a frictional damping force that opposes movement of the cup within the raceway. The seat and cap can be mutually adapted so that when assembled the seat and cap provide a clamping force to clamp the cup in the raceway and define an amount of frictional damping between the strut part and mounting part of the coupling. The clamping force between the seat and cap maintains a positive force between the cup and the seat. A positive force between the cup and the seat is intended to mean that the cup is forced or pressed against the seat.

In the preferred embodiment a surface friction damping element is located between the cup and the raceway to influence frictional damping characteristics of the coupling. For example, a surface friction damping element may be a pad (not shown) located in a recess 22 formed in one or both surfaces of the cup facing the seat and cap. Alternatively, a recess for receiving a friction damping element may be formed in the cap or the seat or both. For example, a recess 22 is provided in the cup of the embodiment of FIG. 7. Preferably the surface friction damping elements are greased foam pads. Alternatively, frictional damping between the mounting part and the strut part of the coupling can be achieved by a predetermined interference fit between these parts. A rim 18 of the cup and a closed perimeter 12 of the raceway define a limit to the extent of pivoting movement between the strut part and the mounting part of the coupling.

The curvature of the pivot cup and mounting part of the coupling could be opposite to the curvature of the preferred illustrated embodiments, so that the pivot centre of the coupling 2 is located intermediate of the first and second ends of the strut.

In use the suspension unit is coupled between a supporting structure and a suspended object to dynamically support the suspended object from the supporting structure. The suspension unit allows axial movement of the strut relative to the coupling 2 at the first end of the strut or the coupling 30 at the second end of the strut to allow the spring to be compressed to absorb linear or axial movement of the suspended object relative to the supporting structure. In the illustrated embodiments the strut part 15 of the coupling at the first end of the strut is adapted to move axially relative to the strut 5. In an alternative embodiment, the strut part of the second coupling 30 may be adapted to move axially relative to the strut.

Preferably the strut part 15 of the coupling 2 and the strut 5 are adapted to provide frictionally damped axial movement between the strut part of the coupling and the strut. In the illustrated embodiments the strut part of the coupling comprises a sleeve 16 for connecting the strut part 15 to the strut 5. Preferably a surface friction damping element is located between the sleeve and the strut to influence frictional damping characteristics of the coupling. For example, pads (not shown) are located in annular recess 17 formed in the sleeve surface facing strut 5. Preferably the surface friction damping elements are greased foam pads. Alternatively, frictional damping between the sleeve and the strut can be achieved by a predetermined interference fit between these parts. In the embodiment of FIG. 7, the sleeve is formed in two parts to provide a recess or cavity 17 for receiving damping foam.

Preferably the strut comprises an abutment 6 disposed adjacent the strut part of the coupling that limits axial movement of the coupling with respect to the strut. The abutment is a member that extends radially from the strut to provide an axially facing surface that limits axial movement of the coupling once the coupling bears against the axially facing surface. Preferably the abutment and the strut are integrally formed. For example, in the preferred embodiment the abutment is formed by splaying an end portion of the hollow strut radially outwards. The spring biases the coupling 2 toward the abutment 6. Axial movement of the coupling away from the abutment compresses the spring. Preferably the spring is slightly compressed with the strut part of the coupling bearing against the abutment.

The pivot cup does not significantly support the weight of the dynamically suspended assembly. Due to the axial movement provided in the suspension assembly and with the spring 25 supporting the mounting part of the pivot coupling, the pivot cup does not support the weight of the suspended assembly. Further, the strut does not support the weight of the suspended assembly; the strut does not take any significant axial load. Therefore the friction damping force between the seat and the cup or between the pivot cup and the raceway is significantly independent of the weight of the dynamically suspended assembly and/or the strength of the compression spring supporting the dynamically suspended assembly. This design allows for an amount of pivoting friction damping to be achieved that is significantly independent of the weight of the suspended assembly. Furthermore, since the strut does not take any significant axial or lateral load, the strut may be relatively lightweight as illustrated by the embodiment of FIG. 7. For example, the strut of the embodiment of FIG. 7 is a 6 mm diameter solid rod or wire. Such a smaller diameter strut may be formed from a length of wire, for example 6 mm diameter steel wire. A smaller diameter strut may also be suitable, for example 4-5 mm diameter.

Figure 6A:
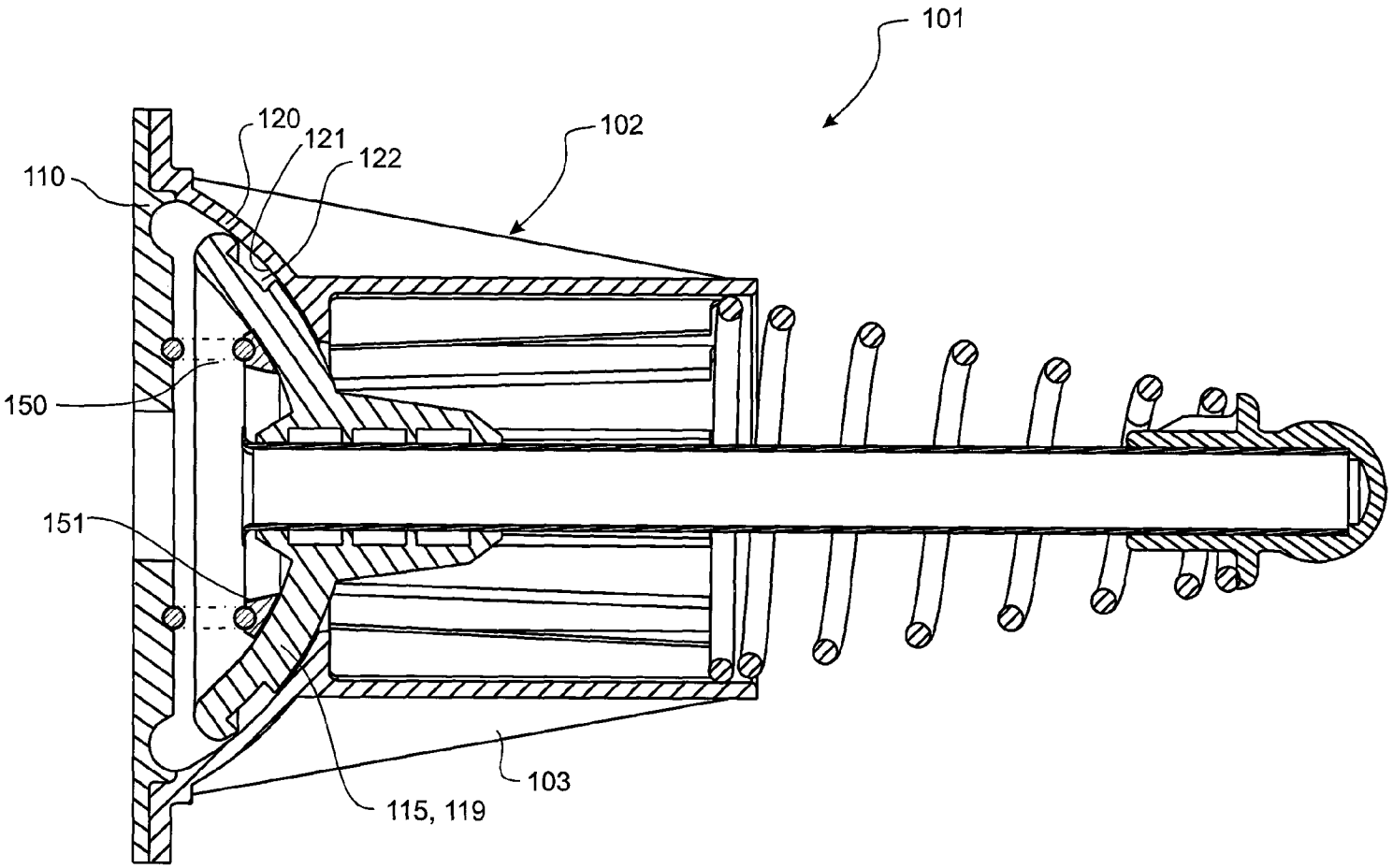
FIGS. 6A and 6B are cross sectional views of two alternative suspension unit assemblies.
Figure 6B:
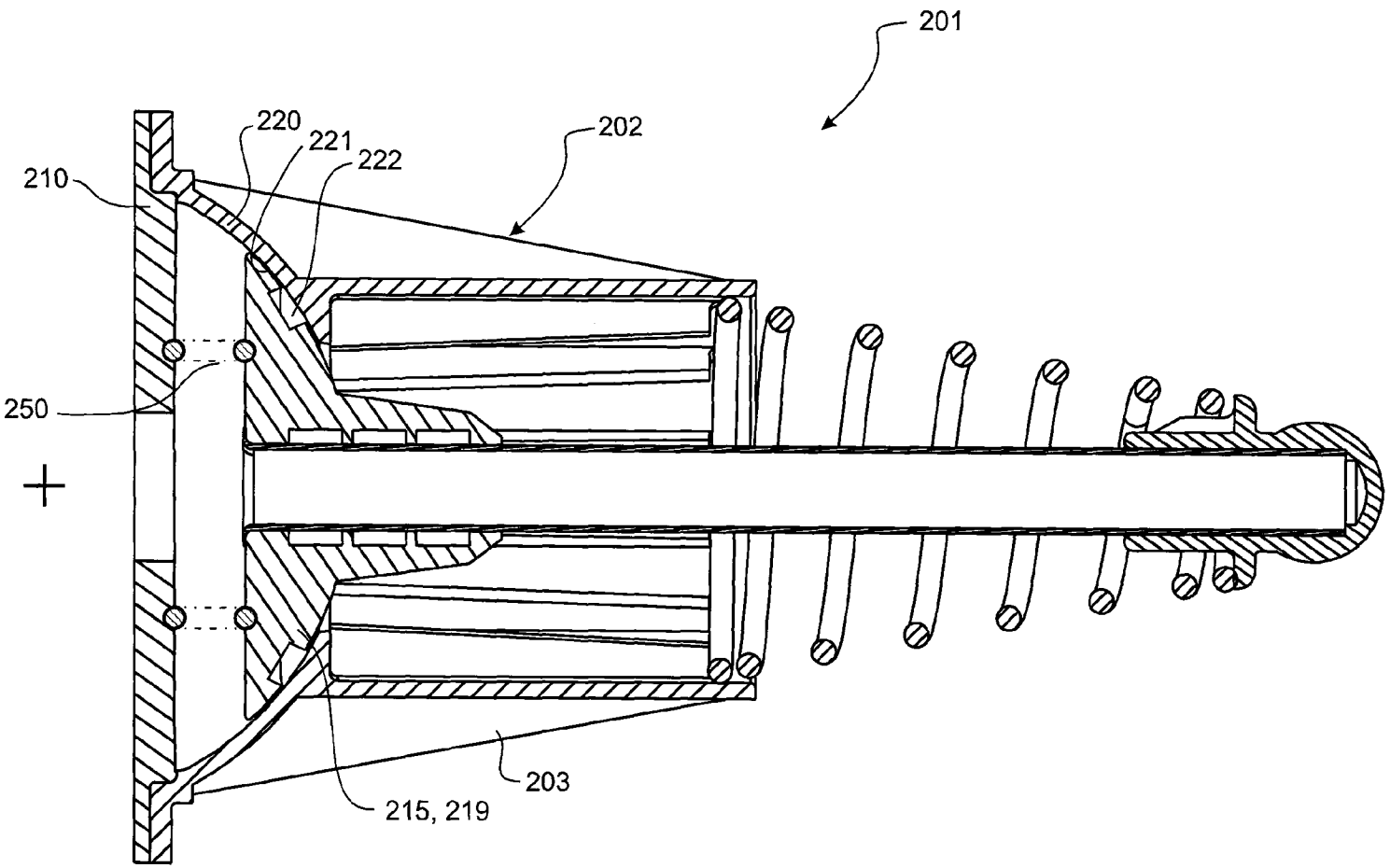

Alternative suspension unit assemblies 101 and 202 are illustrated in FIGS. 6A and 6B, each comprising an alternative pivot coupling, 102 and 202.

The coupling 102 of the embodiment of FIG. 6A comprises a strut part 115 and a mounting part 103. The strut part 115 and mounting part 103 are adapted to provide frictionally damped movement between the strut part and the mounting part of the coupling. In the illustrated embodiment, the strut part of the coupling comprises a pivot cup 119. The mounting part of the coupling comprises a seat 120 for receiving the cup, and a cap 110. The seat and the cap are connected together at an edge region. The seat comprises a concave surface 121 to match the curved convex surface of the cup. A spring 150 is provided between the cap 110 and the cup 119 to maintain contact between the curved surfaces of the seat and the cup. The seat bears against the cup to create a frictional damping force that opposes movement of the cup. The spring is selected to provide a suitable amount of contact pressure between the seat and the cup to achieve a desired amount of frictional damping for the particular use of the suspension unit.

In the illustrated embodiment of FIG. 6A, a surface friction damping element is located between the cup and the seat to influence frictional damping characteristics of the coupling. For example, a surface friction damping element may be a pad (not shown) located in a recess 122 formed in the curved surface of the cup facing the seat. Preferably the surface friction damping elements are greased foam pads.

A bearing element 151 may be provided between the cup 119 and the spring 150. In the illustrated embodiment the spring 150 is received in a groove in one side of the bearing element, and an opposed side of the bearing element is complementarily shaped to contact the concave curved surface of the cup 119.

The coupling 202 of the embodiment of FIG. 6B comprises a strut part 215 and a mounting part 203. The strut part 215 and mounting part 203 are adapted to provide frictionally damped movement between the strut part and the mounting part of the coupling. In the illustrated embodiment, the strut part of the coupling comprises a ball 219. The ball can be formed as a part of a sphere. The ball is a body having a concave surface. The mounting part of the coupling comprises a seat 220 for receiving the ball, and a cap 210. The seat and the cap are connected together at an edge region. The seat comprises a concave surface to match the curved concave surface of the ball. A spring 250 is provided between the cap 210 and the ball 219 to maintain contact between the seat and the ball. The seat bears against the ball to create a frictional damping force that opposes movement of the ball. The spring is selected to provide a suitable amount of contact pressure between the seat and the ball to achieve a desired amount of frictional damping for the particular use of the suspension unit.

In the illustrated embodiment, one end of the spring is received in a groove in the cap 210, and an opposite end of the spring is received in a grove in the ball 219. Pivoting movement between the strut part 225 and the mounting part 203 causes the spring 250 to elastically bend; one side of the spring compresses more than an opposite side of the spring as the ball moves in the seat. The lateral stiffness of the spring 250 resists bending and lateral deflection of the spring. Thus the lateral stiffness of the spring will act to return the coupling to the equilibrium or central position.

In the illustrated embodiment of FIG. 6B, a surface friction damping element is located between the ball and the seat to influence frictional damping characteristics of the coupling. For example, a surface friction damping element may be a pad (not shown) located in a recess 222 formed in the curved surface of the ball facing the seat. Preferably the surface friction damping elements are greased foam pads.

Figure 4:
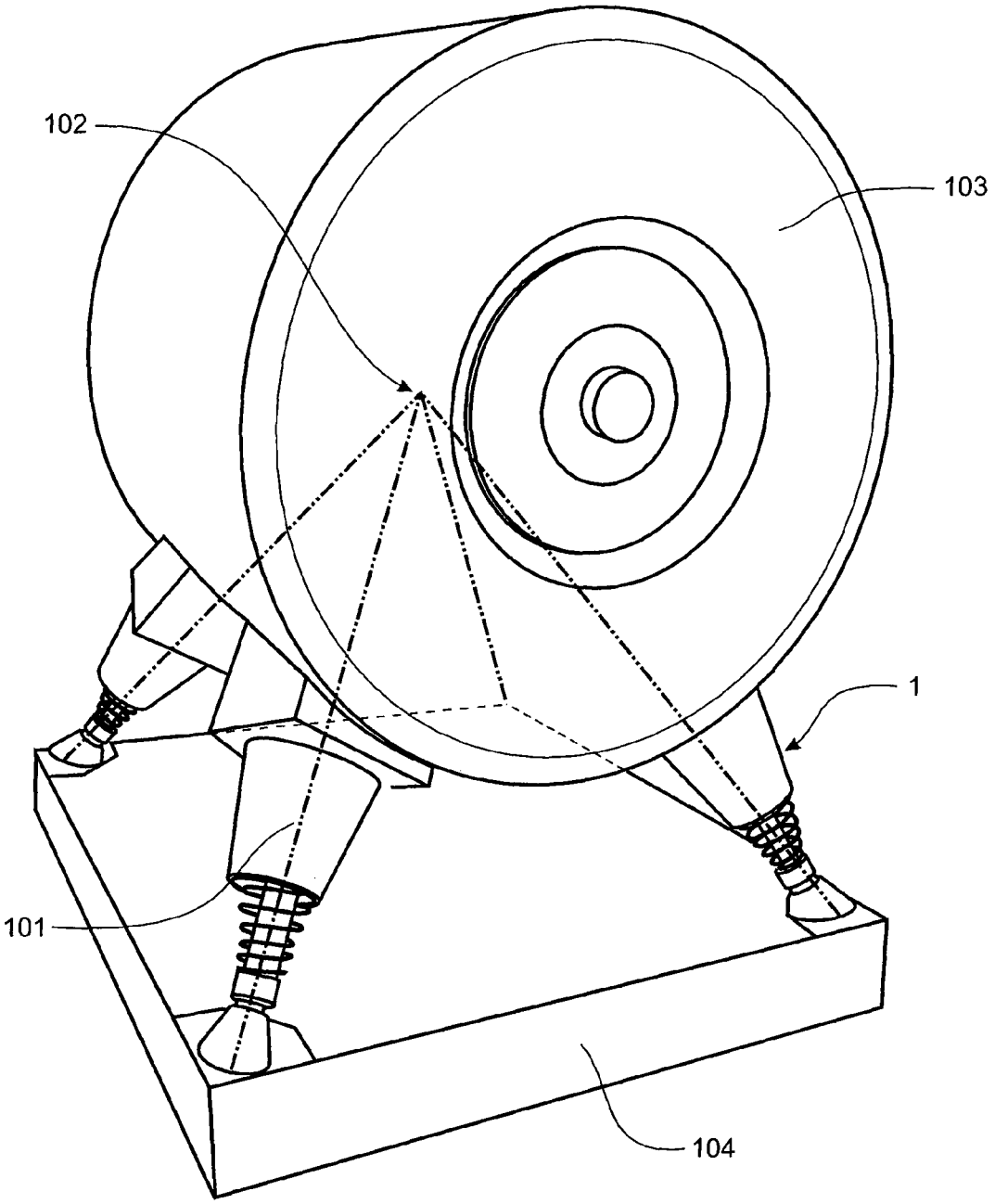
FIG. 4 shows a dynamically suspended assembly of a washing machine comprising a tub and a drum (not shown) rotationally mounted in the tub, the dynamically suspended assembly supported by four suspension units extending from a support structure.

A suspension unit according to the present invention is specifically intended to be used in a washing machine assembly for dynamically suspending a tub and drum assembly. The suspension unit is intended to be coupled between the tub and a supporting structure, the suspension unit coupled to the supporting structure below the tub so that compression of the spring 25 resists axial movement of the coupling 2 along the strut towards the second end of the strut. Preferably a washing machine assembly comprises at least 3 suspension units. In a preferred embodiment the washing machine has four suspension units as illustrated in FIG. 4. Where there are three or more struts, the spring must be retained relative to the mounting side of at least one of the first and second couplings, so that the lateral stiffness of the springs is utilised. In an alternative embodiment, the tub can be supported with a single suspension unit if the spring is retained relative to the mounting side of both the first and second couplings (or to the tub mounted to the first coupling and the support structure supporting the second coupling).

Three or more suspension units according to the present invention can be used to support the tub from below since the lateral stiffness of the spring in each suspension unit is utilized. The lateral stiffness of the spring of each suspension unit acts to provide a centralizing force to return the tub to a neutral or equilibrium position.

The illustrated embodiment comprises a spring restrained relative to the tub or mounting part of the upper coupling. In an alternative embodiment, the spring can be restrained relative to the mounting part of the lower coupling or support structure supporting the strut, with an upper end of the spring restrained relative to the strut 5.

A suspension unit according to the present invention may be used to dynamically support the tub and drum assembly in a horizontal axis or vertical axis machine. In this specification and claims, a horizontal axis machine is a machine that has the rotating laundry drum supported so that the longitudinal axis of the drum is horizontal or at an angle of up to 45 degrees from horizontal. And a vertical axis machine is a machine that has the rotating laundry drum supported so that the longitudinal axis of the drum is vertical or at an angle of up to 45 degrees from vertical. A horizontal axis machine may be front or top loading. A benefit for using suspension units according to the present invention in a top loading horizontal axis machine to support the tub and drum assembly is that the tub suspension mounting points do not interfere with the circumferential opening of the drum or the drum circumferential hatch or hatch operating mechanism.

Use of a suspension unit according to the present invention is not limited to use in a washing machine. Suspension units according to the present invention may be used to support any body or assembly that needs to be supported dynamically. For example, a suspension unit according to the present invention may be used to support the rotational laundry drum in a laundry drying machine. Furthermore, a pivot coupling comprising a first part being a pivot cup and a second part having a raceway that supports the pivot cup to provide pivoting movement between the first part and the second part of the pivot coupling as described herein may be a useful component for use in any assembly where a pivot joint or coupling between two parts is required.

A further improvement can be achieved by supporting a tub and drum assembly from below using a suspension unit that is aligned so that a longitudinal axis of each suspension unit extends through the approximate centre of gravity of the dynamically suspended assembly. This arrangement is illustrated in FIG. 4 wherein four suspension units 1 (one obscured from view) are angled inwardly from a base 104 so that the longitudinal axis 101 of each suspension unit extends through the approximate centre of gravity 102 of the dynamically supported tub and drum assembly 103.

An amount of rotational or lateral stiffness is required from the suspension units so that the lowest energy state for the dynamically suspended system is towards the centre of the movement range for the dynamically suspended system.

As the drum spins through the natural rocking resonance speed, any out of balance, caused for example by unevenly distributed laundry within the drum, causes the tub and drum assembly (the dynamically suspended system) to rock about the centre of mass of the dynamically suspended system.

The rocking resonance speed of the dynamically suspended assembly is dependent on the rotational or lateral stiffness of the suspension system (the suspension units supporting the dynamically suspended assembly) about the centre of mass of the dynamically suspended system. Therefore the resistance to rotation of the dynamically suspended system about the centre of gravity should be carefully controlled so that the resonance can be passed through at a suitably low speed when the oscillations are less energetic.

The linear stiffness of the suspension units does not contribute any useful self centering force, but if the springs are aligned at an angle away from the centre of gravity of the dynamically suspended assembly they will apply a moment about the centre of gravity and cause an unwanted increase in the rocking stiffness of the suspension system. For this reason the suspension units should be aligned so that the longitudinal axis of the spring of each suspension unit is aligned towards the approximate centre of gravity of the dynamically suspended system. Preferably the each said suspension assembly is aligned so that a line along the longitudinal axis of the spring of each suspension assembly extends within the smallest of one quarter of the diameter of the drum or one quarter of the length of the drum.

As illustrated, the lower end of each unit is supported on a base or support structure 104. Therefore a cabinet (not shown) for enclosing the illustrated assembly has a minimum structural requirement and can be somewhat isolated from vibration of the dynamically supported assembly.

Preferably each suspension unit aligned towards the centre of gravity of the dynamically suspended assembly is a suspension unit according to the present invention. However, an assembly comprising a plurality of prior art suspension units each having a suspension spring will be improved if the suspension springs are aligned to the centre of gravity of the dynamically suspended system.

For example, in a prior art washing machine comprising suspension springs and separate damping units, an improvement will be achieved if the suspension springs are aligned to the centre of gravity of the tub and drum assembly.

The foregoing description of the invention includes preferred forms thereof. Modifications may be made thereto without departing from the scope of the invention as defined by the accompanying provisional claims.

What is claimed is:

1. A laundry machine comprising:

a dynamically suspended assembly including a drum for holding laundry rotationally mounted with the dynamically suspended assembly, a supporting structure below the dynamically suspended assembly, a pivot coupling mounted to one of the dynamically suspended assembly and the supporting structure, and a strut connected between the pivot coupling and the other one of the dynamically suspended assembly and the supporting structure, the strut having an axis, the pivot coupling comprising:

a first part, and a second part configured to pivot relative to the first part of the coupling, the first part attached to the strut and the second part mounted to said one of the dynamically suspended assembly and the supporting structure, wherein the first part of the pivot coupling comprises a pivot cup or ball having a first curved surface, and the second part of the pivot coupling comprises a second curved surface providing a seat that supports the first curved surface of the pivot cup or ball wherein a frictional damping force between the first and second curved surfaces opposes movement of the pivot cup or ball relative to the seat during pivoting movement between the first part and the second part of the pivot coupling, a compression spring between the second part of the pivot coupling and the other one of the dynamically suspended assembly and the supporting structure such that the second part of the pivot coupling significantly supports the weight of the dynamically suspended assembly, and a component for maintaining a positive force between the first and second curved surfaces, wherein the pivot coupling is adapted to move axially relative to the strut such that the first part of the pivot coupling does not significantly support the weight of the dynamically suspended assembly and so that the frictional damping force between the first and second curved surfaces is substantially independent of the weight of the dynamically suspended assembly.

2. A laundry machine as claimed in claim 1, wherein the first part of the pivot coupling comprises the pivot cup, and the component for maintaining a positive force between the first and second curved surfaces is a cap, the second part of the pivot coupling comprising the cap and the seat, complimentarily curved facing surfaces of the seat and the cap defining a raceway for receiving the pivot cup, a clamping force between the seat and cap maintaining the positive force between the first and second curved surfaces.

3. The laundry machine as claimed in claim 2, wherein the second curved surface comprises one of a convex surface or concave surface and the cap comprises a third curved surface, the third curved surface comprising the other one of a convex surface or concave surface, the second curved surface facing the third curved surface, the second curved surface and the third curved surface defining the raceway, and the first curved surface of the cup comprises the other one of a convex surface and a concave surface, and the pivot cup comprises a fourth curved surface opposite the first curved surface, the fourth curved surface of the pivot cup comprises the one of a convex surface or a concave surface, wherein each of the concave and convex surfaces of the pivot coupling have the same radius of curvature.

4. The laundry machine as claimed in claim 2, wherein the seat and the cap bear against the pivot cup to create the frictional damping force that opposes movement of the pivot cup within the raceway.

5. The laundry machine as claimed in claim 2, wherein the seat or the cap is integrally formed with one of the dynamically suspended assembly and the supporting structure.

6. The laundry machine as claimed in claim 2, wherein a rim of the pivot cup and a closed perimeter of the raceway define a limit to the extent of pivoting movement between the first part and the second part of the pivot coupling.

7. A laundry machine as claimed in claim 1, wherein the second part comprises a cap, and the component is a spring acting between the cap and the pivot cup or ball to maintain the positive force between the first and second curved surfaces.

8. A laundry machine as claimed in claim 7, wherein the first part of the pivot coupling comprises the pivot cup and the pivot coupling further comprises a bearing element between the pivot cup and the spring, the bearing element contacting a curved side of the pivot cup, opposite to the first curved surface.

9. A laundry machine as claimed in claim 1, wherein the first curved surface is convex and the second curved surface is concave.

10. The laundry machine as claimed in claim 1, wherein the pivot coupling allows at least two degrees of freedom of rotational movement between the first part and the second part of the pivot coupling.

11. The laundry machine as claimed in claim 1, wherein the first part of the pivot coupling is adapted to move axially relative to the strut.

12. The laundry machine as claimed in claim 11, wherein the first part of the pivot coupling and the strut are adapted to provide frictionally damped axial movement therebetween.

13. The laundry machine as claimed in claim 1, wherein the strut has an abutment disposed adjacent the first part of the pivot coupling that limits axial movement of the pivot coupling with respect to the strut.

14. The laundry machine as claimed in claim 1, wherein the first part of the pivot coupling comprises a sleeve for connecting the pivot cup or ball to the strut.

15. The laundry machine as claimed in claim 14, wherein the sleeve and the strut are formed to provide frictionally damped axial movement between the pivot cup or ball and the strut.

16. The laundry machine as claimed in claim 1, wherein a surface friction damping element is located between the first curved surface and the second curved surface to influence frictional damping characteristics of the pivot coupling.

17. The laundry machine as claimed in claim 14, wherein a surface friction damping element is located between the sleeve and the strut to influence frictional damping characteristics between the pivot coupling and the strut.

18. The laundry machine as claimed in claim 1, wherein the compression spring is adapted to resist both axial movement of the pivot coupling relative to the strut and also to resist relative pivotal movement between the first and second parts of the pivot coupling.

* * * * *